US005087519A

United States Patent [19]

Yamaguchi et al.

[11] Patent Number: 5,087,519

[45] Date of Patent: Feb. 11, 1992

[54] ETHYLENE-VINYL ALCOHOL COPOLYMER COMPOSITE FIBER AND PRODUCTION THEREOF

[75] Inventors: Shinji Yamaguchi; Kiyoshi Hirakawa, both of Kurashiki; Seiji Kashima, Takatsuki; Kazuhiko Tanaka, Kurashiki; Masao Kawamoto, Kurashiki; Takao Akagi, Kurashiki, all of Japan

[73] Assignee: Kuraray Company Limited, Kurashiki, Japan

[21] Appl. No.: 444,794

[22] Filed: Dec. 1, 1989

[30] Foreign Application Priority Data

Dec. 5, 1988 [JP] Japan ..... 63-308492

[51] Int. Cl.[5] ..... D02G 3/00

[52] U.S. Cl. ..... 428/373; 8/115.56; 428/374; 428/397

[58] Field of Search ..... 428/364, 373, 374, 397; 8/115.5, 115.6

[56] References Cited

U.S. PATENT DOCUMENTS 3,080,207 3/1963 Tanabe et al. .
3,741,724 6/1973 Harmon .
4,145,371 3/1979 Tohyama et al. ..... 524/130 X
4,173,504 11/1979 Tomioka et al. ..... 156/180
4,261,373 4/1981 Tamaoki et al. ..... 156/180 X
4,270,962 6/1981 Sugihara et al. ..... 156/180
4,323,626 4/1982 Kunimune et al. ..... 428/373
4,483,897 11/1984 Fujimura et al. ..... 428/373 X

OTHER PUBLICATIONS

WPI, File Supplier, Derwent Publication Ltd., London, GB; AN-80-11820C & JP-A-56 005 846 (Nippon Synth. Chem. Ind.) 7-02-81 Whole Abstract.

*Primary Examiner*—Lorraine T. Kendell
*Attorney, Agent, or Firm*—Oblon, Spivak, McClelland, Maier & Neustadt

[57] ABSTRACT

Provided is a composite fiber comprising an ethylene-vinyl alcohol copolymer and a thermoplastic polymer. The composite fiber is acetalized with a dialdehyde such that the ethylene-vinyl alcohol copolymer has a melting point in a specified range, whereby the composite fiber does not cause serious stickings between the filaments when dyed, sewn or ironed and is excellent in hydrophilic property, resistance to soiling, antistatic property and the like. The composite fiber is thus very suitable for clothing use.

3 Claims, 2 Drawing Sheets

ETHYLENE-VINYL ALCOHOL COPOLYMER COMPOSITE FIBER AND PRODUCTION THEREOF

BACKGROUND OF THE INVENTION

1. Field of the invention

The present invention relates to ethylene-vinyl alcohol copolymer composite fibers which are highly thermostable and can hence be used for clothing use.

In particular, the present invention relates to a technique for obtaining a composite fiber comprising a component (A) of a saponified product of an ethylene-vinyl acetate copolymer and a component (B) of a thermoplastic polymer, which has excellent thermal stability so that said fiber or fabrics containing said fiber do not cause sticking or adhesion by component A by dry heat treatment or hot water treatment. The present invention also relates to a technique for preventing said composite fiber from coloring upon acetalization treatment. Further the present invention relates to a technique for preventing dyed articles comprising said fiber from discoloration upon heating after the acetalization treatment. Still further the present invention relates to a technique for dyeing articles comprising said fiber without causing the died articles to shrink or deteriorate and without impairing the hand and appearance of the articles. 2. Description of the prior art Composite fibers comprising a saponified product of ethylene-vinyl acetate copolymer and a hydrophobic thermoplastic resin such as polyesters, polypropylene or polyamides are disclosed in for example Japanese patent publication Nos. 5846/1981 and 1372/1980.

Ethylene-vinyl alcohol copolymer fibers have, thanks to the hydroxyl groups contained in the molecules, superior features such as hydrophilic property, soil-resistant property and antistatic property as compared to conventional melt-spun synthetic fibers. However, they have drawbacks of 10 inferior thermal stability against high-temperature hot water, steam or the like because of their low melting point and softening temperature. The above-cited patents disclose a technique of providing a composite fiber comprising an ethylene-vinyl alcohol copolymer and a thermoplastic polymer having a thermal stability higher than the ethylene-vinyl alcohol copolymer, thereby providing the fiber with dimensional stability and the like. The fibers obtained by the techique however still have drawbacks of causing part of the ethylene-vinyl alcohol copolymer component exposed on the fiber surface to soften or slightly stick together to stiffen the hand or impair the appearance when dyed under high-temperature and high-pressure conditions or heated with a steam iron at sewing or on occasions during use. Then, for the purpose of dyeing the fiber without generating such trouble, the dyeing temperaure must be lowered to 90° C. or below; and a dyeing at a temperature above this Would cause the ethylene-vinyl alcohol copolymer component to soften and fuse so that the desired product cannot be obtained. On the other hand, the other component of the composite fiber cannot sufficiently be dyed at such low temperature of 90° C. or below. As a result, the fiber has no appropriate dyeing temperature range to dye the both components, thus having no dyeability. Furthermore, fabrics containing the fiber still have problems unsolved of generating a significant change in the appearance by ironing at sewing or on occasions during use. It is thought that such fatal problems have made the composite fiber of this type commercially unsuccessful.

SUMMARY OF THE INVENTION

Accordingly, an object of the present invention is to provide a highly thermostable composite fiber comprising a component of a saponified product of an ethylene-vinyl acetate copolymer, which does not cause sticking or fusion of the component at high temperatures.

Another object of the present invention is to provide a process for producing such composite fiber.

Still another object of the present invention is to provide a method of treatment for the above composite fiber, which does not cause coloring at acetalization, discoloration of the dyed articles after the acetalization, or shrinkage or deterioration at dyeing.

Thus, the present invention provides a composite fiber comprising a component (A) of a saponified product of an ethylene-vinyl acetate copolymer having an ethylene content of 30 to 70 mol % and a component (B) of a thermoplastic polymer, said component A being exposed on at least part of the surface of said composite fiber and acetalized with a compound represented by the following formula [I] an said component A having a melting point satisfying the following formula [II]

$$OCH—C_nH_{2n}—CHO \quad [I]$$

wherein n is 0 or an integer of 1 to 10, $$-1.524\times(Et\%)+234<Ma \quad [II]$$

where

Et% = ethylene content in component A (mol %]and

Ma = melting point of component A (.C); and, more preferably, a composite fiber as defined above wherein residual non-crosslinked aldehyde groups of said compound have, after the acetalization reaction, been formed by action of $NaHSO_3$ into $—C_nH_{2n}CHO.NaHSo_3$, or oxidized into groups of carboxylic acid or a salt thereof.

Further the present invention provides a process for producing an ethylene-vinyl alcohol copolymer composite fiber, which comprises acetalizing:

a composite fiber comprising a component (A) of a saponified product of an ethylene-vinyl acetate copolymer having an ethylene content of 30 to 70 mol % and a component (B) of a thermoplastic polymer, said component A being exposed on at least part of the surface of said fiber, in the form of an aggregate of cut fibers, a yarn or a fabric, at a temperature, T, of 15 to 135° C. with a solution containing a strong acid and a compound of the above formula [I] in a concentration, N, of 0.05 to 2 normals and in a concentration, C, of 0.002 to 5 moles/l respectively, said T, N and C at the same time satisfying the following relationship [III]

$$N\leqq 0.548-0.576\times\log C-6.3\times10^{-3}\times T \quad [III]$$

where

N = concentration of strong acid (normals),

C = concentration of dialdehyde (moles/l) and

T = acetalization temperature (°C);

said acetalization treatment being most preferably conducted with said acetalization solution further containing at least 5 g/l of the salt of a strong acid and a strong base; and, more preferably, a process which comprises first heat-treating the above-described ethylene-vinyl alcohol copolymer composite fiber, in the form of an aggregate of cut fibers, a yarn or a fabric, at a temperature above 100° C. and below the melting point of component A and then acetalizing the thus heat-treated fiber in the above-described way.

Still further the present invention provides a process for treating said composite fiber with a solution or dispersion of $NaHSO_3$ before its exposure to a temperature above 140° C., after acetalization and before or after dyeing; or treating said composite fiber with an oxidizing agent before its exposure to a temperature above 140° C., after acetalization and before or after dyeing.

The present invention still further provides a method for dyeing the composite fiber after being acetalized, which comprises dyeing the fiber with an aqueous dyeing bath at 95° C. or above, said dyeing bath containing at least 5 g/l of the salt of a strong acid and strong base, at least 10 g/l of boric acid or at least 1 g/l of the base of a strong acid and a strong base together with at least 5 g/l of boric acid.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein.

DETAILED DESCRIPTION OF THE PREFERRED EMBODIMENT

Figure 1:
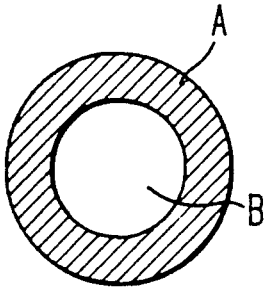
FIGS. 1 through 7 are cross-sectional views of representative examples of the composite fiber of the present invention, where hatched parts indicate component A, and blank parts component B.
Figure 2:
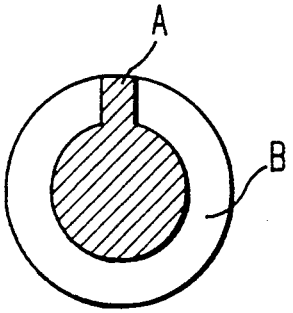
Figure 3:
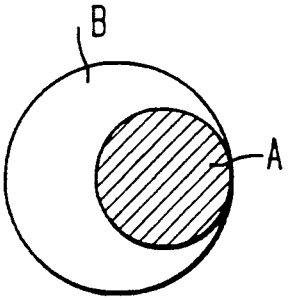
Figure 4:
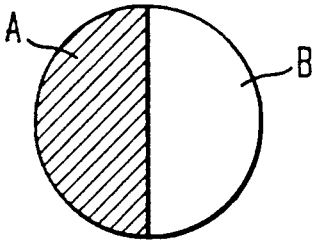

The composite iiber of the present invention comprises the afore-mentioned component polymer A and component polymer B and has a structure in which the component A is exposed on at least part of the fiber surface, in other word on the entire surface or on part of the surface, of the fiber. This structure is assured by for example a concentric or eccentric sheath-core fiber comprising the component A as the sheath, a side-by-side composite fiber, or a multi-layer composite fiber or fiber of nonuniformly mixed structure in which the component A is partly exposed on the fiber surface. The composite fiber may be as-spun fiber obtained by high-speed spinning or drawn fiber from conventionally spun fiber, or it may be a false twisted textured yarn.

In the present invention, the above-described composite fiber is acetalized, not with a monoaldehyde such as formaldehyde or benzaldehyde, but with a dialdehyde represented by the afore-described formula [I], such as glyoxal, malonaldehyde or glutaraldehyde, whereby the melting point of component A is, because of crosslinking between molecules thereof, made considerably higher than that before acetalization. Then, the fiber acetalized will have a high resistance to hot water and, surprisingly, the thus elevated melting point will not substantially be decreased by treatment with hot water such as high-temperature dyeing bath at a temperature above 90° C., e.g. 130° C. which is generally adopted for dyeing polyester fibers, resulting in perfect prevention of the fiber from softening and fusion. Further in the present invention, it is preferred to dryheat treat the acetalized fiber prior to dyeing such that the decrease in the melting point of polymer A is less than 1° C., which is assured by conducting the heat treatment at a temperature lower than the melting point of the acetalized polymer. Then, the thus heat-treated fiber will be completely free from softening or fusion even when dyed at a high temperature of 130° C. If the dry heat treatment is conducted at a temperature above the melting point of the acetalized component A, i.e. Ma described before, the hot water resistance of component A will decrease, which is not preferred.

The ethylene-vinyl alcohol copolymer composite fiber thus obtained has sufficient thermal stability for the practical purpose, and fabrics containing the fiber can be ironed at sewing or steam-ironed during use without causing softening or fusion. On the other hand, conventional ethylene-vinyl alcohol copolymer fibers which have not been acetalized cause polymer A contained therein to soften and fuse when dyed at a high temperature of 130° C., and fabrics containing such fibers will then become stiff and thus have no commercial value.

The composite fiber obtained as above according to the present invention has the following attendant effects. The fiber will, thanks to crosslinking by acetalization, increase its water-swelling property, making the most of the swelling effect of polymer A, thereby providing the fabric containing the fiber with a natural bulk with enlarged waves of weave.

The melting point, Ma, of the component A after acetalization must be in the range represented by the aforementioned formula [II]. If Ma is lower than $-1.524\times(Et\%)+234$, the afore-mentioned excellent effect by acetalization cannot be realized. With Ma of $[-1.524\times(Et\%)+263]$ or higher, the composite fiber will be colored upon acetalization. It is therefore most preferred that Ma satisfy the aforementioned formula [II] and at the same time be lower than $[-1.524\times(Et\%)+263]$.

Compounds represented by the afore-mentioned formula [I] are used for the acetalization of the composite fiber. With the compounds of formula [I] wherein n is higher than 10, it is difficult to conduct acetalization, and, if ever acetalized, the obtained fiber would have insufficient resistance to hot water. More preferably, n is in the range of from 0 to 6.

In the present invention, the acetalization is conducted in the presence of a strong acid such as sulfuric acid, formic acid or hydrochloric acid, among which sulfuric acid is preferred from the viewpoint of efficiency of acetalization reaction. The concentration of the strong acid in the acetalization solution, being in the range of from 0.05 to 2 normals, the acetalization temperature, being in the range of from 15 to 135° C. and the concentration of the compound represented by formula [I] in the acetalization solution, being in the range of from 0.002 to 5 moles/l, preferably in the range of 0.01 to 1 mole/l, are selected such that the afore-mentioned relationship [III] is satisfied. If the strong acid concentration is not more than 0.05 normal, the composite fiber acetalized will not be of a sufficient thermal stability, While concentrations higher than 2 normals will cause the acetalized fiber to be fragile. If the acetalization temperature is lower than 15° C., the acetalization reaction will proceed too slowly to obtain a composite fiber having satisfactory thermal stability even when conducted under conditions satisfying the relationship [III], while an acetalization temperature higher than 135° C. will cause the fabrics comprising the composite fiber to discolor and become fragile. If the dialdehyde concentration is lower than 0.002 mole/l, the composite fiber acetalized under conditions satisfying the relationship [III] will still be of very low degree of acetalization and hence be short of thermal stability to stand against heat treatment at processing or against high-temperature dyeing. If on the other hand the dialdehyde concentration exceeds 5 moles/l, the composite fiber will be colored at acetalization and further discolor at dyeing. Further in the case where the indivisual conditions for the three factors, i.e. strong acid concentration, N, acetalization temperature, T, and dialdehyde concentration, C, are all satisfied and still the relationship [III] is not satisfied, a satisfactory result cannot be obtained either. For example, If the strong acid concentration, N, is, while being in the range of 0.05 to 2 normals, larger than that calculated from $[0.548-0.576\times\log C-6.3\times10^{-3}\times T]$, the composite fiber acetalized will be fragile and yellowish.

Figure 8:
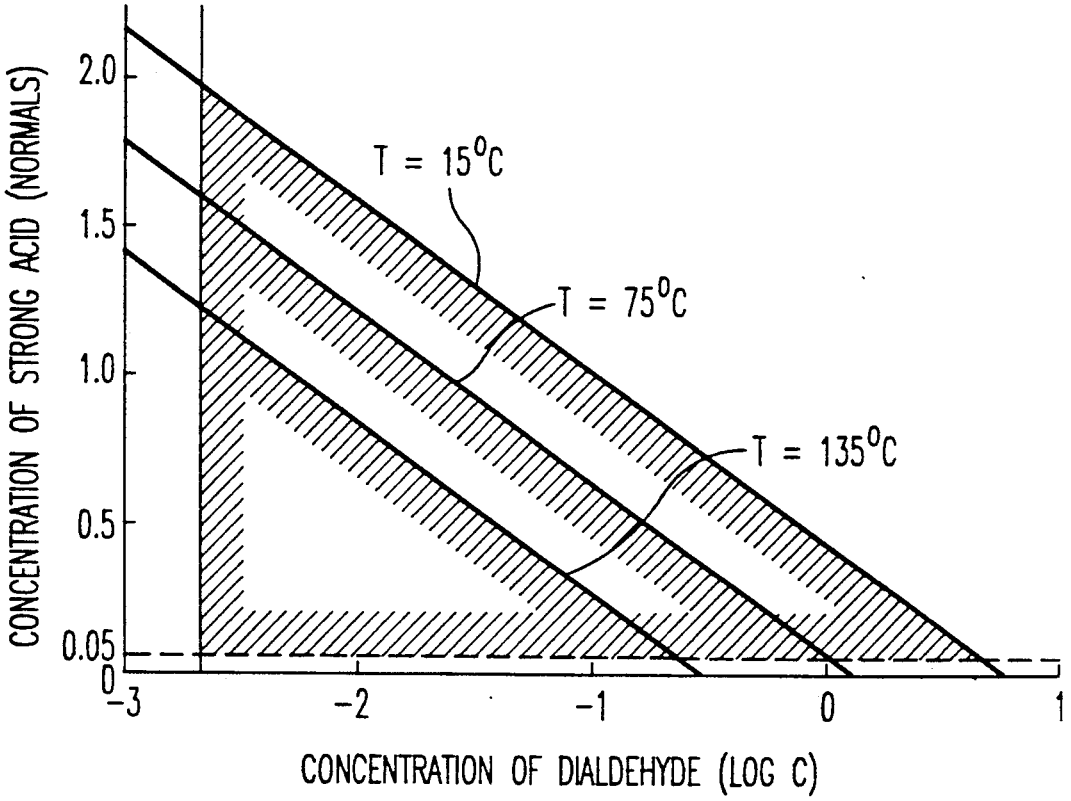
FIG. 8 is a graph where the ordinate represents the concentration (normals) of strong acid and the abscissa represents the concentration (moles/l) of dialdehyde, illustrating the appropriate concentration ranges at 15, 75 and 135° C. by hatching.

FIG. 8 shows suitable condition ranges by hatched areas with respect to the above individual conditions and the relationship [III], where the abscissa represents the logarithm of the dialdehyde concentration, logC, and the ordinate represents the strong acid concentration, the acetalization temperature being taken as a parameter.

As stated heretofore, the present invention provides the ethylene-vinyl alcohol copolymer composite fiber with sufficient thermal stability by acetalization under the above-described appropriate conditions. The present invention further provides a process for still improving the thermal stability of the acetalized composite fiber, which comprises heat treating prior to acetalization the composite fiber in the form of an aggregate of cut fibers, yarn or fabric, under tension or in a relaxed state at a temperature above 100° C. and below the melting point of component A. Where the composite fiber in the form of a fabric is heat treated, it is preferred that the fabric be heat treated in a relaxed state for the purpose of giving high bulk to the yarns comprising the composite fiber, thereby providing the treated fabric with more distinguished waves of weave and bulky hand. Where the composite fiber is heat treated in the form of an aggregate of short cut fibers or a yarn, the heat treatment is also preferably conducted in a relaxed state for higher development of fiber crimps.

The thus heat treated fiber exhibits upon acetalization a markedly larger increase in the melting point of component A as compared with that in the case of non-heat-treated fiber, and, surprisingly, achieves excellent improvement in resistance to hot water. For assuring the above-mentioned marked increase in the melting point, the heat treatment is preferably conducted at a temperature 5° to 10° C. lower than the melting point of component A before acetalization, and above 100° C. With the heat treatment at lower than 100° C., no significant increase in the melting point is realized by acetalization, resulting in no significant improvement in resistance to hot water. The heat treatment in the present invention means a process which comprises heating the fiber by dry heat setting, microwave heating, heating with superheated steam or by infrared radiation, or the like.

While the present invention has achieved, as described above, by heat treatment prior to acetalization, a sufficient improvement in the thermal stability of the acetalized ethylene-vinyl alcohol copolymer composite fiber, it has been found that the composite fiber tends to color upon acetalization. The present invention then provides a method to solve this point, which comprises conducting the acetalization of the composite fiber under the above-specified conditions, said acetalization solution further containing at least 5 g/l of the salt of a strong acid and a strong base.

Examples of the salt of a strong acid and a strong base are sodium sulfate, potassium sulfate, sodium chloride, potassium chloride and the like, among which sodium sulfate is preferred.

With a concentration of less than 5 g/l, the salt of a strong acid and a strong base will not produce a sufficient effect On the other hand, if the salt concentration in the dyeing bath exceeds 50 g/l, the rate of acetalization reaction will be too small. The bath concentration is therefore preferably selected from the range of from 5 to 50 g/l, and more preferably from the range of from 10 to 30 g/l.

The purpose of this treatment is as follows. When acetalization is conducted with a dialdehyde, crosslinking reaction is effected. Some free aldehydes, which are each one of the two aldehyde groups of the dialdehyde, however, remain non-crosslinked and may cause the acetalized fiber, after dyeing, to discolor upon heating. Such a trouble is prevented by this treatment. The free aldehydes are either blocked by formation of a $NaHSO_3$-adduct of $-C_nH_{2n}CHO$ with $NaHSO_3$, e.g. $R-CH(OH)SO_3Na$, or converted into carboxylic acids or salts thereof by oxidation of the aldehydes.

Still further the present invention provides, for the case where component B of the composite fiber is a polyester which requires high-temperature dyeing with high-temperature bath, a process of high-temperature dyeing causing no trouble on component A, which comprises dyeing the composite fiber after acetalization with an aqueous dyeing bath containing at least 5 g/l of the salt of a strong acid and a strong base, at least 10 g/l of boric acid, or both at least 1 g/l of the salt of a strong acid and a strong base and at least 5 g/l of boric acid.

The object of this process is, when dyeing at 95° C. or above a fabric containing the composite fiber comprising component A exposed on part of or all the surface thereof, to prevent the fiber from shrinkage and deterioration due to the action by the ethylene-vinyl alcohol copolymer constituting component A, which has been acetalized with a dialdehyde, thereby being capable of dyeing the fabric without impairing its hand and appearance.

Conventional polyester fibers have been dyed by high-temperature dyeing at about 130° C. When a fabric containing the composite fiber of the present invention which comprises the above-mentioned component A and a polyester, particularly polyethylene terephthalate, as polymer component B is dyed at a high temperature suited for dyeing the polyester side, it sometimes occurs that the fabric loses commercial value caused by its very large shrinkage by action of polymer A and by its whitening due to deterioration of polymer A resulting from the large shrinkage.

The dyeing process of the present invention which comprises having the dyeing bath to contain, either singly or in combination, boric acid and the salt of a strong acid and a strong base, can prevent the fabric from shrinkage caused by that of polymer A, thereby preventing polymer A from deterioration and thus preventing the fabric from whitening.

In the present invention, as mentioned above, boric acid and the salt of a strong acid and a strong base may be used singly, but preferably the both are used in combination. Where the salt of a strong acid and a strong base is used singly, its concentration in the dyeing bath is at preferably least 5 g/l, and more preferably at least 15 g/l. Where only boric acid is used, it is contained in the bath in a concentration of preferably at least 10 g/l, and more preferably at least 20 g/l. If the salt of a strong acid and a strong base or boric acid is contained in a concentration not more than 5 g/l or not more than 10 g/l respectively, the above-described effect will not fully be produced. Where the salt of a strong acid and a strong base is used in combination with boric acid, their concentrations are preferably at least 1 g/l and at least 5 g/l respectively, for the purpose of producing the above-mentioned effect.

Examples of the salt of a strong base and a strong base used in the present invention are sodium sulfate, potassium sulfate, sodium chloride and potassium chloride, among which sodium sulfate is preferred.

In the composite fiber used in the present invention, which comprises polymer A of a saponified product of an ethylene-vinyl acetate copolymer having an ®thylene content of 30 to 70 mol % and a polymer B of a different thermoplastic polymer. If the ethylene content exceeds 70 mol %, the vinyl alcohol content will decrease, whereby the content of hydroxyl groups decreases so that the composite fiber detracta from its desirable features, such as hydrophilic property. On the other hand, if the ethylene content is lower than 30 mol % to thereby increase the vinyl alcohol content too much, the melt formability will decrease and, when the polymer A is, together with a thermoplastic poly mer B, formed into filaments, the spinnability will be worse to cause freguent filament breakage and yarn breakage, which is not preferred. The suitable range of the ethylene content in the saponified product of an ethylene-vinyl acetate copolymer is therefore in the range of from 30 to 70 mol %. The saponified product preferably has a saponification degree of at least 98 mol % from the viewpoint of resistance to hot water.

The composite fiber of the present invention may, as mentioned before, assume various structures including one in which polymer B entraps polymer A but not wholly along the longitudinal direction of a filament, a side-by-side structure, a sheath-core structure in which polymer A wholly entraps polymer B, and the like, examples of their cross sections being shown in FIGS. 1 through 7. The composite fiber of the present invention is not limited to the examples shown in the FIGURES, and, for example it needs not be true circular but may be elliptic, triangular, rectangular, multiangular, multilobal or the like. In any structure, polymer A must be exposed on at least part of the fiber surface, since otherwise the desirable features of polymer A, such as hydrophilic property, resistance to soiling and antistatic property cannot be utilized.

The polymer B used in this invention, i.e. a thermoplastic polymer other than polymer A, includes any polymer capable of being melt spun, but preferably those having a melting point higher than ethylene-vinyl alcohol copolymer. Examples of such polymer are polyethylene terephthalate, copolyesters having at least 80 mol % of ethylene terephthalate residue with their acid component or glycol component modified with a component other than terephthalic acid or ethylene glycol component respectively, polybutylene terephthalate, polyhexamethylene terephthalate, copolyesters of the foregoing, nylon 6, nylon 66, nylon 12, copolyamides of the foregoing, copolyesterethers, polyesteramides, polyphenylene sulfide, and the like. particularly preferred are polymers having a melting point of at least 160° C. from the viewpoint of thermal resistance capable of application to clothing use as well as various non-clothing uses. The ratio of polymer A to polymer B in a fiber is preferably 10:90 to 99:1 by area occupied in the cross section.

When the ethylene-vinyl alcohol copolymer composite fiber of the present invention is used for blend yarns or union woven or knitted cloths in combination with a natural fiber such as cotton, silk or wool, the natural fiber often degrades, because of its poor acid resistance, by the acid used at the afore-mentioned acetalization. This problem can be avoided by first acetalizing the ethylene-vinyl alcohol copolymer composite fiber alone in the form of an aggregate of cut fibers, a yarn such as hank, yarn or cheese, and then blending the acetalized fiber with the natural fiber.

The ethylene-vinyl alcohol copolymer composite fiber of the present invention itself has a characteristic of giving fabrics with soft hand. Fabrics with still superior soft hand and higher elasticity can however be obtained by acetalizing the composite fiber in the form of tubular knit fabric to stabilize crimping, then unknit the fabric to obtain crimped yarn, and weaving or knitting the thus crimped yarn alone or in combination with a natural fiber.

Other features of the invention will become apparent in the course of the following descriptions of exemplary embodiments which are given for illustration of the invention and are not intended to be limiting thereof.

EXAMPLES

In the Examples, various evaluations were made as follows:

Thermal stability (1) Hand after heating

Fabrics each made up of a specimen fiber, which had been dyed by high-temperature high-pressure dyeing at 100° C. or above, or dried or heatset at 170° C. were evaluated for their hand and those giving no feel of filament sticking were judged as good.

(2) Ironing test

Specimen fabrics were steam-ironed with a protective cloth on them and then evaluated for the change in their hand before and after the ironing.

(3) Colorfastness of dyed articles against heat.

Dyed articles were heatset at 170° C. for about 1 minute and checked for discoloring.

Melting point of polymer A

Differential scanning calorimetry (hereinafter abbreviated as DSC) was conducted under following conditions and the endotherm was recorded.

specimen kept at 30° C. for 3 min $\xrightarrow{\text{temperature elevation rate: 10° C./min}}$ 220° C.

Measurement of percentage crimp

A hank is prepared from the specimen yarn, and the hank is treated with hot water at 90° C. for 30 minutes under an initial load of 1 mg/dr. Then, the hank is removed of the initial load, air-dried, and measured for distance, $l_1$, between two points on it under an initial load of 1 mg/dr. A second load of 100 mg/dr is added to the initial load and the distance bitween the same two points, $l_2$, is measured. The percentage crimp is calculated from:

$$\text{Percentage crimp (\%)} = \frac{l_2 - l_1}{l_2} \times 100$$

EXAMPLE 1

Figure 5:
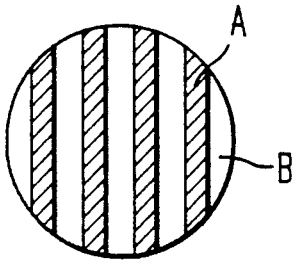
Figure 6:
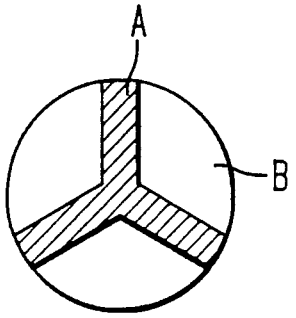
Figure 7:
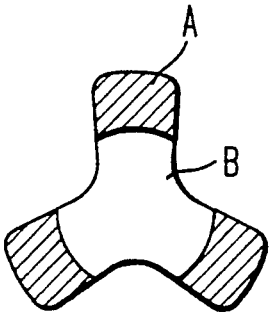

A composite fiber was prepared as follows. A saponified product of an ethylene-vinyl acetate copolymer was used as polymer A, which had a saponification degree of 99%, an ethylene content of 48 mol % and an intrinsic viscosity measured at 30° C. in a 85/15 mixed solvent of phenol/water of $[\eta] = 1.1$ dl/g. A polyethylene terephthalate, in chip form, was used as polymer B, which had an inherent viscosity measured at 30° C. in a 1/1 mixed solvent of tetrachloroethane phenol of $[\eta] = 0.59$. The ratio by weight of copolymer A to polymer B was 2:3. The two polymers were extruded through a spinneret at 265° C. in such a way as to give a composite fiber having a cross section as shown in FIG. 5 and taken up at 1,200 m/min. The fiber as spun was 2-stage drawn through water baths, with the first bath and second bath temperatures being 65° C. and 85° C. respectively to a total drawing ratio of 4.0 and crimped and cut in the usual way to give a staple fiber of 1.5 d × 38 mm.

The fiber thus obtained was immersed in a bath containing 0.07 mol/l of glyoxal, 8 g/l of sulfuric acid and 0.3 g/l of $NaHSO_3$ as an anti-coloring agent at 80° C. for 120 minutes to be acetalized there, neutralized with a hot alkali water, washed with a sufficient amount of water, applied with a finish, squeezed and dried.

The thus acetailized fiber, as well as the non-acetalized fiber as Comparative Example 1, was each blended with 50% of cotton to give a spun yarn of 30's. The spun yarns were separately woven into 1/1 plain weave for shirting.

The polymer A of the non-acetalized fiber showed a melting point, as obtained from the endotherm by DSC, of 159° C., and the fabric obtained from the fiber got a little stiffened when heatset at 160° C. and its hand became still worse by ironing test.

On the other hand, the acetalized fiber showed an melting point of polymer A determined by the same DSC method of 162° C., which was higher than that of the non-acetalized fiber and satisfied the afore-mentioned relationship [II], and further the fabric obtained therefrom had a soft hand, without causing such problems as encountered in the case of the above non-acetalized fabric. Furthermore, when the fabric was then sewn into a shirt and the shirt was actually worn, it showed a good resistance to soiling, with no distinct oily soil at the neck and sleeve. Also, the shirt was nicer to wear than conventional polyester/cotton shirting.

EXAMPLES 2 THROUGH 6 AND COMPARATIVE EXAMPLES 2 THROUGH 7

As polymer B, chips of a polyethylene terephthalate copolymerized with 10 mol % of isophthalic acid (hereinafter referred to as IpA-pES) having an intrinsic viscosity at spinning of $[\eta] = 0.68$ dl/g were used. As polymer A, used were chips of a saponified product of an ethylene-vinyl acetate copolymer (hereinafter referred to as EVOH) having a saponification degree of 99%, an ethylene content of 46 mol % and an intrinsic viscosity of $[\eta] = 1.12$ dl/g. The two polymers were extruded through a spinneret at 260° C. into a plurality of sheath-core composite filaments, the cross section being as shown in FIG. 1, with the sheath of EVOH and the core of IpA-pES and the composite ratio of EVOH-/IpA-pES of 1/1, and the bundle of the filaments was taken up at 1,000 m/min. The filament bundle thus spun was drawn through a conventional roller-plate drawing machine, while being contacted to a hot roller at 75° C. and a hot plate at 120° C., by a drawing ratio of 4.1 to give a composite filament yarn of 50 dr/24 f.

The composite filament yarn thus obtained was used both for warp and weft and woven into a taffeta with 97 ends/in and 88 picks/in. The grey taffeta was desized with 1 g/l aqueous solution of a nonionic surfactant (Actinol R-100, available from Matsumoto yushi-Seiyaku Co., Ltd.) at 80° C. for 20 minutes, and acetalized (hereinafter abbreviated as "GA-ized") with aqueous solutions containing glutaraldehyde in concentrations shown in Table 1 at temperatures shown, for 50 minutes.

In Examples 2 through 5, the GA-ization conditions were within the afore-mentioned range specified by the present invention; while in Comparative Example 2 GA-ization was not conducted, in Comparative Examples 3 and 4 the GA concentrations were outside the specified range, in Comparative Examples 5 and 6 the GA-ization temperatures were outside the specified range, in Comparative Example 7, the sulfuric acid concentration was below the specified range of 0.05 to 2 normals and in Comparative Example 8 the sulfuric concentration did not satisfy the afore-mentioned relationship [III].

These conditions are summarized together with evaluation results in Table 1. In Examples 2 through 5, all the melting points of polymer A satisfied the afore-mentioned relationship [II], and all the fabrics showed a good hand after ironing test and no trouble was encountered at their processing.

TABLE 1

| | Composition of acetalization solution | | | Melting point | Hand | |
|---|---|---|---|---|---|---|
| | Concentration of glutaraldehyde (mol/l) | Concentration of sulfuric acid (normals) | Acetalization temperature (°C.) | of side-A polymer (°C.) | after ironing test | Troubles at processing |
| Example 2 | 0.05 | 0.31 | 90 | 167 | | |
| Example 3 | 0.05 | 0.08 | 120 | 168 | | |
| Example 4 | 4.9 | 0.06 | 20 | 165 | | |
| Example 5 | 0.002 | 1.8 | 20 | 164 | | |
| Comparative Example 2 | | non-GA-ized | | 162 | X | sticking at presetting |
| Comparative Example 3 | 0.001 | 0.31 | 90 | 162 | X | " |
| Comparative | 5.02 | 0.5 | 15 | 163 | X | GA-ized fabric colored; |

TABLE 1-continued

| | Composition of acetalization solution | | | Melting point | Hand | |
|---|---|---|---|---|---|---|
| | Concentration of glutaraldehyde (mol/l) | Concentration of sulfuric acid (normals) | Acetalization temperature (°C.) | of side-A polymer (°C.) | after ironing test | Troubles at processing |
| Example 4 | | | | | | color change after ironing |
| Comparative Example 5 | 0.05 | 0.31 | 10 | 162 | X | sticking at presetting |
| Comparative Example 6 | 0.05 | 0.31 | 140 | 163 | X | GA-ized fabric discolored and became fragile |
| Comparative Example 7 | 0.05 | 0.03 | 90 | 163 | X | sticking at presetting |
| Comparative Example 8 | 0.05 | 1.9 | 90 | 163 | X | GA-ized fabric colored and became fragile |

Hand evaluation
: good
Δ: marginal
X: bad (stiff due to filament stickings, or plastic-like hand)

EXAMPLES 6 THROUGH 9 AND COMPARATIVE EXAMPLE 9

As polymer B, chips of a polyethylene terephthalate copolymerized with 8 mol % of isophthalic acid (IpA-pES) having an intrinsic viscosity at spinning of [η] 0.65 dl/g were used. As polymer A, used were chips of a saponified product of an ethylene-vinyl acetate copolymer (EVOH) having a saponification degree of 99%, an ethylene content of 44 mol % and an intrinsic viscosity of [η] =1.10 dl/g. The two polymers were extruded through a spinneret at 265° C. into a plurality of sheath-core composite filaments, the cross sections being as shown in FIG. 1, with the sheath of EVOH and the core of IpA-pES and the composite ratio of EVOH-/IpA-pES of 1/1, and the bundle of the filaments was taken up at 1,000 m/min. The filament bundle thus spun was drawn through a conventional roller-plate drawing machine, while being contacted to a hot roller at 75° C. and a hot plate at 120° C. to a total drawing ratio of 4.1 to give a composite filament yarn of 50 dr/24 f.

The composite filament yarn thus obtained was used both for warp and weft and woven into a taffeta with 97 ends/in and 88 picks/in. The grey taffeta was desized with 2 g/l aqueous solution of sodium carbonate at 80° C. for 40 minutes, neutralized with a dilute aqueous acetic acid, and then acetalized with aqueous solutions containing 0.05 mole/l of GA, 0.3N of sulfuric acid and sodium sulfate in concentrations shown in Table 2 at 90° C. for 120 minutes. The thus GA-ized taffetas were then neutralized, washed with water, dried and evaluated for discoloring and dyeability in terms of yellowness index, b*, and color development, L", respectively, according to CIE calorimetric system. The results are shown in Table 2.

TABLE 2

| | Concentration of sodium sulfate in GA-ization solution (g/l) | Melting point of polymer A (°C.) | Yellowness index b | Color development L* |
|---|---|---|---|---|
| Example 6 | 7 | 171 | 1.5 | 45.0 |
| 7 | 20 | 172 | 0.7 | 43.5 |
| 8 | 0 | 169 | 9.1 | 47.5 |
| 9 | 3 | 170 | 6.8 | 47.0 |
| Comparative Example 9 | non-GA-ized | 166 | — | — |

In Examples 6 and 7, where the GA-ization solution contained sodium sulfate in concentrations within the range specified by the present invention, the melting point of polymer A increased satisfactorily, and further the taffetas after being acetalized showed only a slight yellowishness. Example 8 is the case where sodium sulfate was not added to the GA solution, and Example 9 the sodium sulfate concentration below the specified range, in both of which satisfactory increases in the melting point of polymer A were achieved with however some yellowishness observed in the acetalized taffetas. Accordingly, the GA conditions employed in Examples 6 and 7 are more preferred since the articles GA-ized under these conditions have high whiteness and further exhibit, after being dyed, high-grade appearance with well developed color.

EXAMPLES 10 THROUGH 13

The taffetas obtained by GA-ization in Examples 6 and 7 were treated with a 5 cc/l aqueous solution of 35% $H_2O_2$ (bath ratio, 50:1) at 80° C. for 30 minutes to eliminate the non-crosslinked aldehyde groups generated at the GA-ization. The taffetas thus treated were pre-heatset with a pin tenter at 140 C, and then dyed by high-temperature stream dyeing under following conditions.

| Dyeing bath | |
|---|---|
| Dyestuff: Sumikaron BLue S-3RF* | 2% owf |
| Dispersing agent: Nikka-Sansolt 7,000** | 0.5 g/l |
| pH adjusting agents: { ammonium sulfate | 1 g/l |
| pH adjusting agents: { acetic acid (48%) | 1 cc/l |
| Bath ratio | 50:1 |
| Temperature and time: 115° C. and 40 minutes | |

*available from Sumitomo Chemical Co.
**available from Nikka Chemical Ind. Co.

The taffetas thus dyed were subjected to reductio clearing for 20 minutes with a solution containing 1 g/l of $Na_2S_2O_4$, 1 g/l of NaOH and 1 g/l of Amiladin (available from Dai-ichi Kogyo Seiyaku Co.), washed with streaming water, dryied, and finally heatset at 140° C. with a pin tenter to give the finished products. The melting point of polymer A was 171° C. and 172° C. respectively for the products obtained from the taffeta in Example 6 and Example 7 (Example 10 and Example 11).

The finished products thus obtained showed no discoloring at all and had an excellent hand.

The taffetas of Examples 10 and 11 were tested for formation of carboxylic acid as follows. The fabrics were treated with $H_2I_2$, whereby the melting points of polymer A did not change, and dyed with the following cation dye together with the untreated fabrics, and the percentage exhaustions were measured.

| Dyeing conditions | |
|---|---|
| Methylene Blue | 2% owf |
| Acetic acid | 1% owf |
| Sodium acetate | 0.5% owf |
| Bath ratio | 50:1 |
| at 90° C. for 1 hour | |

The percentage exhaustions of the fabrics (Example 10 and Example 11) before $H_2O_2$ treatment were both 5%, while those of the fabrics after the treatment (Example 12 and Example 13) were both 20%. This means that the amount of carboxylic acid increased by $H_2O_2$ treatment.

EXAMPLES 14 AND 15 AND COMPARATIVE EXAMPLE 10

As polymer B, chips of a polyethylene terephthalate copolymerized with 8 mol % of isophthalic acid (IpA-pES) having an intrinsic viscosity at spinning of [η] 0.65 dl/g were used. As polymer A, used were chips of a saponified product of an ethylene-vinyl acetate copolymer (EVOH) having a saponification degree of 99%, an ethylene content of 44 mol % and an intrinsic viscosity of [η] =1.10 dl/g. The two polymers were extruded through a spinneret at 265° C. into a plurality of sheath-core composite filaments, the cross section being as shown in FIG. 1, with the sheath of EVOH and the core of IpA-pES and the composite ratio of EVOH-/IpA-pES of 1/1, and the bundle of the filaments was taken up at 1,000 m/min. The filament bundle thus spun was drawn through a conventional roller-plate drawing machine, while being contacted to a hot roller at 75° C. and a hot 10 plate at 120° C., to a total drawing ratio of 4.1 to give a composite filament yarn of 50 dr/24 f.

The composite filament yarn thus obtained was used both for warp and weft, the warp being a z-twisted yarn 300 turns/M and the wefts being a hard Z-twisted yarn of 2,500 turns/M and a hard S-twisted yarn of 2,500 turns/M. A satin crepe Was Woven with them, While two ends each of the two different Wefts were placed alternately. The fabric had a structure of !64 ends/in and 97 picks/in.

The grey satin crepe thus obtained was, as Example 14, dry heat treated at 150° C. for about 1 minutes in a relaxed state. Then, the fabric was scoured and desized in a solution containing 1 g/l of sodium hydroxide and 0.5 g/l of Actinol R-100 at 80° C. for 30 minutes, and then GA-ized with a solution containing 0.05 mole/l of glutaraldehyde, 15 g/l of sulfuric acid and 20 g/l of sodium sulfate at a bath ratio of 50:1 and at 90 C for 120 minutes. The thus GA-ized fabric was neutralized with a dilute alkali solution, washed with a sufficient amount of water, and oxidized with a 5 cc/l aqueous solution of $H_2O_2$ (35%) at a bath ratio of 50:1 and at 80 C for 30 minutes. After being pre-heatset at 140° C., the fabric was high-temperature jet dyed under the following conditions and then finally heatset at 140° C. Separately, as Example 15, the fabric without the above dry heat treatment at 150° C. was scoured and desized, acetalized, neutralized, washed, oxidized, pre-heatset, high-temperatur ®dyed and finally heatset in the same manner as in Example 14.

| Dyeing conditions | |
|---|---|
| Dyestuff: Sumikaron Blue SE-RPD* | 2% owf |

-continued

| Dyeing conditions | | |
|---|---|---|
| Dispersing agent: Nikka-Sansolt 7,000 | | 0.5 g/l |
| pH adjusting agents: | ammonium sulfate | 1 g/l |
| | acetic acid (48%) | 1 cc/l |
| Bath ratio, | | 50:1 |
| Temperature and time: 120° C., 40 minutes | | |

*available from Sumitomo Chemical Co.

As Comparative Example 10, the grey satin crepe which had been dry heat treated at 150° C. and scoured and desized in Example 14 was, without being acetalized, high-temperature jet dyed at 120° C. in the same manner as in Example 14. The three fabrics obtained above were evaluated for the hand and the melting point of polymer A by using DSC. The results are shown in Table 3.

TABLE 3

| | Dry heat treatment | Acetalization | Hand after being dyed | Melting Point of polymer A |
|---|---|---|---|---|
| Example 14 | yes | yes | very soft and bulky | 182° C. |
| 15 | no | yes | soft | 172 |
| Comparative Example 10 | yes | no | stiff due to fiber sticking | 166 |

In the Examples, particularly in Example 14, the fabric after the dyeing had a good hand. In Example 14, where dry heat treatment was conducted prior to acetalization at a temperature below the melting point of polymer A, the melting point of polymer A after being acetalized increased, which preventes the polymer A from stiffening by high-temperature dyeing, thereby giving a very soft and bulky finished product having a high-grade appearance.

EXAMPLES 16 THROUGH 23

As polymer B, chips of a polyethylene terephthalate (hereinafter referred to as pET) having an intrinsic viscosity at spinning of [η] =0.71 dl/g were used. As polymer A, used were chips of a saponified product of an ethylenevinyl acetate copolymer (EVOH) having a saponification degree of 99%, an ethylene content of 48 mol % and an intrinsic viscosity of [η] =1.10 dl/g. The two polymers were extruded through a spinneret at 270° C. into a plurality of sheath-core composite filaments, the cross section being as shown in FIG. 1, with the sheath of EVOH and the core of pET and the composite ratio of EVOH/pET of 1/1, and the bundle of the filaments was taken up at 1,000 m/min. The filament bundle thus spun was drawn through a conventional roller-plate drawing machine, while being contacted to a hot roller at 75° C. and a hot plate at 120° C., to a total drawing ratio of 4.1 to give a composite filament yarn of 50dr/24f.

The composite filament yarn thus obtained was used both for warp and weft and woven into a taffeta with 98 ends/in and 89 picks/in. The grey taffeta was desized with 1 g/l aqueous solution of Actinol R-100 at 80° C. for 20 minutes. The melting point of polymer A of the desized fabric was 162° C. The fabric was then acetalized with a solution containing 0.05 mol/l of GA, 15 g/l of sulfuric acid at a bath ratio of 50:1 and at 90° C. for 60 minutes. The taffeta thus acetalized was then pre-heatset at 140° C. The melting point of polymer A of the fabric was 165° C.

The fabric was then dyed with dyeing baths containing sodium sulfate and boric acid in concentrations shown in Table 4 at 130° C. for 40 minutes under the conditions shown below and then subjected to reduction clearing in the usual way. The thus dyed fabrics were evaluated for the shrinkage after being dyed and cleared, the change in the hand by high-temperature dyeing and the appearance, as well as for the melting point of polymer A determined by DSC.

| Dyeing conditions | |
|---|---|
| Dyestuff: Sumikaron Blue S-3RF | 2% owf |
| Dispersing agent: Nikka-Sansolt 7,000 | 0.5 g/l |
| pH adjusting agents: ammonium sulfate | 1 g/l |
| pH adjusting agents: acetic acid (48%) | 1 cc/l |
| Additives: shown in Table 4 | |
| Bath ratio: | 50:1 |
| Temperature and time: 130° C., 40 minutes | |

As shown in Table 4, in Examples 16 through 19, where the dyeing bath contained sodium sulfate and boric acid in concentrations specified by the present invention, the fabrics dyed at 130° C. showed a suppressed shrinkage by dyeing, thereby exhibiting both nice hand and good appearance to be high-grade fabrics. On the other hand, in Examples 20 through 23, where sodium sulfate and boric acid were contained in the dyeing bath in concentrations below the range specified by the present invention, the fabrics dyed showed a large, though not fatal, shrinkage by high-temperature dyeing.

TABLE 4

| | Additive concentration | | Melting | Shrinkage | Hand change by high- | |
|---|---|---|---|---|---|---|
| | sodium sulfate (g/l) | boric acid (g/l) | point of polymer A | of fabric width by dyeing | temperature dyeing at 130° C. | Appearance of dyed fabric |
| Example 16 | 30 | 0 | 165° C. | 10% | bulky | calm shade |
| Example 17 | 0 | 15 | 165 | 10 | bulky | " |
| Example 18 | 5 | 10 | 165 | 8 | bulky | " |
| Example 19 | 30 | 30 | 165 | 2 | flexible | calm shade |
| Example 20 | 0 | 0 | 164 | 40 | too large shrinkage | whitened |
| Example 21 | 3 | 0 | 164 | 38 | " | " |
| Example 22 | 0 | 5 | 164 | 30 | " | " |
| Example 23 | 0.8 | 5 | 164 | 35 | " | " |

EXAMPLE 24

The same grey fabric as used in Example 2 was desized in the same way, and acetalized with a solution containing 0.04 mole/l of glutaraldehyde, 15 g/l of sulfuric acid and 20 g/l of sodium sulfate at a bath ratio of 50:1 and at 90° C. for 50 minutes. The acetalized fabric was pre-heatset at 150° C. The fabric was then dyed and reduction-cleared in the same manner as in Example 10, and then treated with a 2% aqueous solution of $NaHSO_3$ at a bath ratio of 50:1 and at 90° C. for 30 minutes to eliminate the non-crosslinked aldehyde groups which had generated by the acetalization. The melting point of polymer A of the fabric was 166° C. The fabric was finally heatset at 150° C. and evaluated for the discoloring which had occurred by the heatsetting, by using CIE L*a*b" calorimetric system, and taking the value b as an index. Elementary analysis on the content of sulfur (S) before and after the treatment with $NaHSO_3$ was also conducted. The results are shown in Table 5.

TABLE 5

| Before final heatsetting | | After final heatsetting | | Before $NaHSO_3$-treatment | | After $NaHSO_3$-treatment | |
|---|---|---|---|---|---|---|---|
| m.p. of polymer A (°C.) | b* | m.p. of polymer A (°C.) | b* | m.p. of polymer A (°C.) | S (%) | m.p. of polymer A (°C.) | S (%) |
| 166 | −39.3 | 166 | −39.2 | 166 | 0.01 | 166 | 0.20 |

Note: m.p. stands for melting point.

As seen from Table 5, when the dyed fabric had been treated with an aqueous NaHSO, solution the fabric did not suffer discoloring upon later heat treatment at a high temperature of 150° C. or so. Further from the observed increase in the content of S by the treatment with $NaHSO_3$, it is considered that $NaHSO_3$-adduct had been formed in the treated fabric. Quantitative determination on the treated fabric for free aldehyde according to JIS-L-1041-83 could not detect any free aldehyde.

EXAMPLE 25

The same composite filament yarn as used in Example 14 was wound into a cheese, and the cheese was scoured with an aqueous solution containing 1 g/l of Actinol R-100 (nonionic surfactant) at 80° C. for 30 minutes. Then the cheese was acetalized with an aqueous solution containing 0.05 mole/l of glutaraldehyde, 15 g/l of sulfuric acid and 20 g/l of sodium sulfate at a bath ratio of 50:1 and at 90° C. for 2 hours. After thorough neuralization of the sulfuric acid and washing with water of the cheese, the cheese was oxidized with a 10 cc/l aqueous solution of hydroperoxide (35%) at a bath ratio of 50:1 and at 80° C. for 30 minutes.

For the purpose of confirming the formation of carboxylic acid, the same dyeing test with the cationic dye as in Example 11 was conducted to show an increase in percentage exhaustion, which indicates an increase in the number of carboxyl groups.

The composite filament yarn thus GA-ized and oxidized was knitted in combination with a worsted yarn into a feeder blend. The knitted fabric thus prepared was an excellent product having a hand similar to the natural fiber, which, as well as the constituting worsted yarn, did show no decrease in tensile strength, elongation and the like.

The melting point of polymer A contained in the composite filament was 172° C.

EXAMPLE 26

The same 50 dr/24 f composite filament yarn as used in Example 6 Was knitted into a tubular knit sheeting of 28 gauges. The fabric was scoured with an aqueous solution containing 1 g/l of Actinol R-100 at 80 C for 30 minutes. Then the fabric was acetalized with an agueous solution containing 0.05 mole/l of glutaraldehyde, 15 g/l of sulfuric acid and 20 g/l of sodium sulfate at a bath ratio of 50:1 and at 90° C. for 90 minutes. After thorough neuralization of the sulfuric acid and washing with water of the fabric, the fabric was oxidized with a 10 cc/l aqueous solution of hydroperoxide (35%) at a bath ratio of 50:1 and at 80° C. for 30 minutes. The thus oxidized fabric was tested for the formation of carboxylic acid in the same manner as in Example 10 and for free aldehyde according to JIS-L-1041-83 to show no increase in carboxylic acid or presence of free aldehyde. The tubular knit fabric was unknitted and the obtained unknit yarn was again knitted into a tubular knit fabric of 28 gauges.

The unknit yarn showed a percentage crimp of 5%. The knitted fabric made up of the unknit yarn had excellent stretch-back property and an excellent, soft hand. The melting point of polymer A of the unknit yarn was 171° C.

EXAMPLES 27 AND 28 AND COMPARATIVE EXAMPLES 11 THROUGH 15

As polymer B, chips of a polyethylene terephthalate copolymerized with 10 mol % of isophthalic acid (IpA-pES) having an intrinsic viscosity at spinning of [η] 0.68 dl/g were used. As polymer A, chips of a saponified product each of ethylene-vinyl acetate copolymers (EVOH) having various ethylene contents shown in Table 6. A pair each of polymer B and each of polymers B's was formed into a plurality of sheath-core composite filaments having the same cross section and under the same spinning and drawing conditions as in Example 2, which was then wound up as a composite filament yarn of 50 dr/24 f.

Each of the composite filament yarns thus obtained was used for both warp and weft and woven into a taffeta with 97 ends/in and 88 picks/in. The grey taffetas were desized and GA-ized under the same conditions as employed in Example 2.

In Examples 27 and 28, the ethylene content of polymer A was in the afore-described range specified by the present invention, while the ethylene content was outside the range in Comparative Examples 11 and 12. Comparative Examples 13, 14 and 15 show the cases where GA-ization was not conducted for Examples 27 and 28 and Comparative Example 12 respectively. The evaluation results are shown in Table 6.

TABLE 6

| | Ethylene content in polymer A (mol %) | Spinnability | GA-ization | m.p. of polymer A (°C.) | Hand after ironing |
|---|---|---|---|---|---|
| Example 27 | 32 | good | yes | 191° C. | |
| Example 28 | 55 | good | yes | 154 | |
| Comp. Ex. 11 | 25 | bad, could not be taken up | — | — | — |
| Comp. Ex. 12 | 80 | good | yes | 112 | X |
| Comp. Ex. 13 | 32 | good | no | 184 | X |
| Comp. Ex. 14 | 55 | good | no | 149 | X |
| Comp. Ex. 15 | 80 | good | no | 111 | X |

Hand: : good
Δ: marginal
X: bad; stiff due to filament stickings, plastic-like

In Examples here, the melting point of polymer A after acetalization showed a satisfactory increase over that before acetiliation, thereby giving composite fibers having high thermal stability to give fabrics with a good hand even after being ironed.

Obviously, numerous modifications and variations of the present invention are possible in light of the above teachings. It is therefore to be understood that within the scope of the appended claims, the invention may be practiced otherwise than as specifically described herein.

What is claimed is:

1. An ethylene-vinyl alcohol copolymer composite fiber comprising a component (A) of a saponified product of an ethylene-vinyl acetate copolymer having an ethylene content of 30 to 70 mol % and a component (B) of a thermoplastic polyester or polyamide, said component A being exposed on at least part of the surface of said composite fiber and acetalized with a compound represented by the following formula [1] and having a melting point satisfying the following relationship [11]

$$OHC—C_{nl\ H2n}—CHO \qquad [I]$$

wherein n is 0 or an integer of 1 to 10, $$-1.524\times(Et\%)+234<Ma \qquad [II]$$

where

Et% = ethylene content in component A (mol %) and

Ma = melting point of component A (.C).

2. The ethylene-vinyl alcohol copolymer composite fiber according to claim 1, wherein non-crosslinked aldehyde groups after acetalization have been formed by action of $NaHSO_3$ into $—C_nH_{2n}CHO.NaHSO_3$.

3. The ethylene-vinyl alcohol copolymer composite fiber according to claim 1, wherein non-crosslinked aldehyde groups after acetalization have been oxidized into carboxylic acid groups or groups of a salt thereof.

* * * * *